US007049914B2

(12) United States Patent
Lamb et al.

(10) Patent No.: US 7,049,914 B2
(45) Date of Patent: May 23, 2006

(54) MULTIPLE OUTPUT MAGNETIC SENSOR

(75) Inventors: Wayne A. Lamb, Freeport, IL (US); Lamap F. Ricks, Freeport, IL (US); Greg R. Furlong, Freeport, IL (US); Curtis B. Johnson, Freeport, IL (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 10/859,311

(22) Filed: Jun. 2, 2004

(65) Prior Publication Data

US 2004/0217832 A1 Nov. 4, 2004

Related U.S. Application Data

(62) Division of application No. 10/336,477, filed on Jan. 3, 2003.

(51) Int. Cl.
*H01H 7/00* (2006.01)

(52) U.S. Cl. ..... 335/216; 340/547; 340/426.28; 335/207

(58) Field of Classification Search ..... 335/216; 340/426.28; 70/264, 276, 271, 274
See application file for complete search history.

(56) References Cited

U.S. PATENT DOCUMENTS

| | | | | |
|---|---|---|---|---|
| 4,295,118 | A * | 10/1981 | Herr et al. | 338/32 H |
| 5,722,706 | A | 3/1998 | Bartel et al. | |
| 5,862,691 | A | 1/1999 | Friedrich et al. | |
| 5,890,384 | A | 4/1999 | Bartel et al. | |
| 6,377,005 | B1 | 4/2002 | Zintler et al. | |
| 6,400,266 | B1 * | 6/2002 | Brown, Jr. | 340/542 |
| 6,705,665 | B1 * | 3/2004 | Buecker et al. | 296/146.9 |

FOREIGN PATENT DOCUMENTS

| | | | |
|---|---|---|---|
| JP | 01271588 A | * | 10/1989 |
| JP | 03140578 A | * | 6/1991 |

* cited by examiner

*Primary Examiner*—Lincoln Donovan
*Assistant Examiner*—Bernard Rojas
(74) *Attorney, Agent, or Firm*—Kris T. Fredrick

(57) ABSTRACT

A door position sensing system includes a door claw having first and second magnets mounted thereon, and a Hall sensor mounted so as to sense the magnetic fields of the first and second magnets. The first magnet is mounted in a door half-latch position, and the second magnet is mounted in a door full-latch position. A processor is responsive to the Hall sensor to provide outputs indicating the half-latch and full-latch positions of a door. The processor may also be arranged to indicate a door open position when neither magnet is near the sensor.

7 Claims, 4 Drawing Sheets

MULTIPLE OUTPUT MAGNETIC SENSOR

CROSS-REFERENCE TO RELATED APPLICATION

This is a Divisional application of Ser. No. 10/336,477, filed Jan. 3, 2003.

TECHNICAL FIELD OF THE INVENTION

The present invention relates to a multiple output magnetic sensor that can be used to sense multiple positions of an object. Such a sensor can be used, for example, to indicate the half-latch and full-latch positions of an automobile door.

BACKGROUND OF THE INVENTION

It is desirable and sometimes necessary to sense the positions of various devices that can assume multiple positions one such device is the door of an automobile. The latches of such doors typically have half-latch and full-latch positions. When the door is in the full-latch position, the latch is fully engaged and the door in its fully closed position. When the door is in the half-latch position, the door in not in its fully closed position but the latch is sufficiently engaged to prevent the door from opening without further intervention by an operator. When the door is in neither the full-latch position nor the half-latch position, the door is open.

There are several reasons to sense these door latch positions. For example, the driver of an automobile can be notified when a door is in the full-latch position, or is in the half-latch position, or is open. Alternatively, power assist doors are being contemplated in which a motor or actuator is used to pull the door tightly closed to, for example, better shut out exterior noise. In this case, it is desirable to sense the half-latch position of the door in order to energize the motor so that it pulls the door to the full-latch position, and to then sense the full-latch position in order to prevent further pulling by the motor.

Hall sensors have been used to sense the position of objects by detecting the presence or absence of a magnetic field. Thus, a small magnet may be attached to an object whose position is be sensed, and the magnetic field of the magnet is detected by the Hall sensor in order to determine the position of the object. If the circuit that processes the signal from the Hall sensor is configured for uni-polar operation and has a digital output, the sensor will turn on when the magnetic field from the magnet exceeds a predefined threshold and will be off the rest of the time (ignoring the effects of hysteresis). Therefore, the circuit will only be able to detect when the object is in a certain discrete position.

In applications requiring the detection of multiple positions, such as the automobile door application discussed above, an encoded signal is frequently utilized. However, if only one Hall sensor is to be used to detect multiple positions, a complex time based extrapolation algorithm is required to determine the multiple positions.

To avoid the use of such an algorithm, a separate discrete Hall sensor can be used to detect each of the various positions of the object. However, the use of multiple Hall sensors increases the cost of the position detection system. In high volume industries such as the automobile industry, the cost can become significant.

The present invention relates to a multiple position sensor that overcomes one or more of these or other problems.

SUMMARY OF THE INVENTION

According to one aspect of the present invention, a door position sensing system comprises a door claw, a receiver, and a processor. The door claw has first and second transmitters mounted thereon. The receiver is mounted so as to receive signals transmitted by the first and second transmitters. The processor is responsive to the receiver to provide outputs indicating first and second positions of a door corresponding to the first and second transmitters.

According to another aspect of the present invention, a system comprises a mounting structure having a periphery, a first magnet, a second magnet, and a magnetic field sensor. The first magnet has a first North pole and a first South pole, and the first magnet is mounted on the mounting structure at the periphery such that the first North pole faces the periphery and the first South pole faces away from the periphery. The second magnet has a second North pole and a second South pole, and the second magnet is mounted on the mounting structure at the periphery such that the second South pole faces the periphery and the second North pole faces away from the periphery. The magnetic field sensor senses the first and second magnets upon relative movement between the magnetic sensor and the mounting structure.

According to still another aspect of the present invention, a door latch claw comprises a door claw plate having a periphery, a first transmitter mounted on the door claw plate at the periphery to transmit a signal indicative of a half-latch position of the door claw plate, and a second transmitter mounted on the door claw plate at the periphery to transmit a signal indicative of a full-latch position of the door claw plate.

BRIEF DESCRIPTION OF THE DRAWINGS

These and other features and advantages will become more apparent from a detailed consideration of the invention when taken in conjunction with the drawings in which.

DETAILED DESCRIPTION

Figure 1:
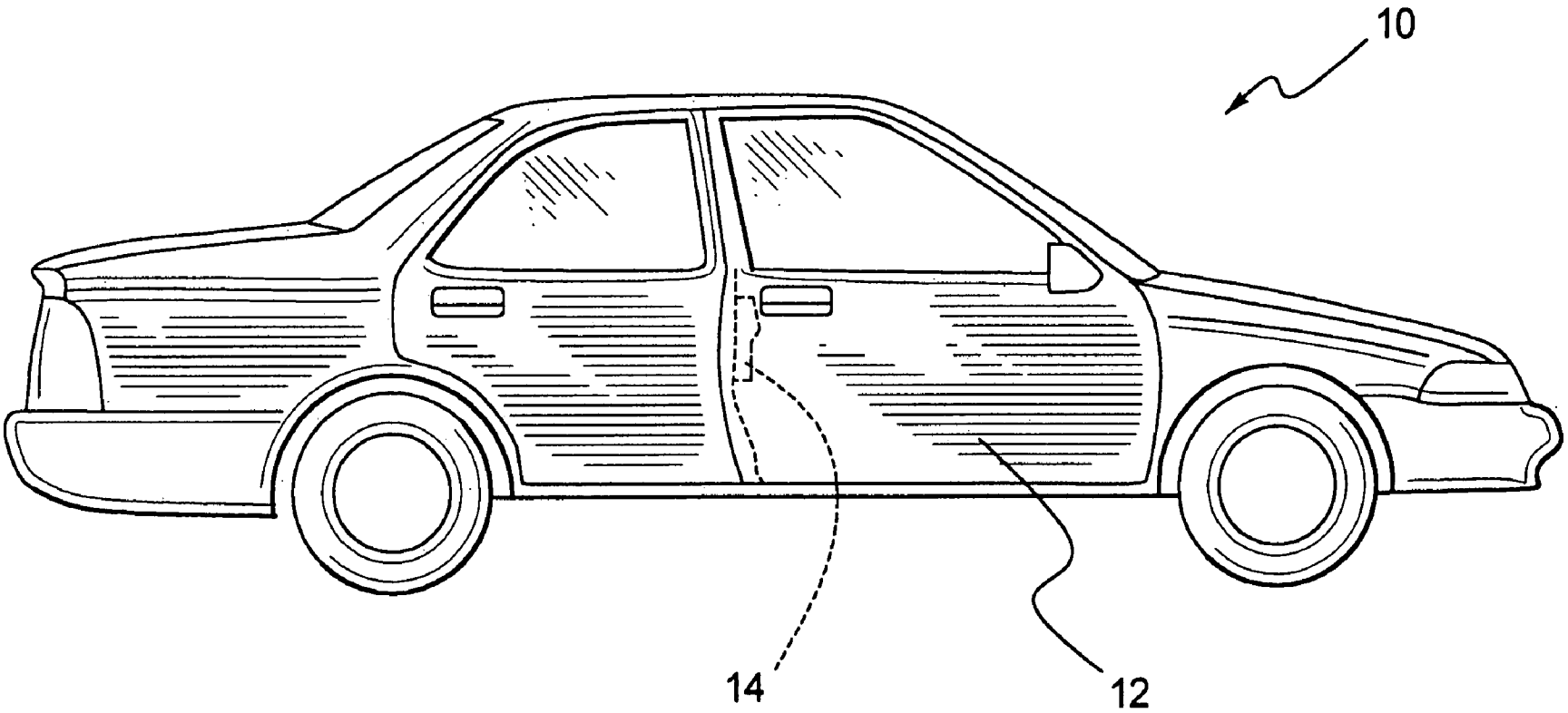
FIG. 1 illustrates an automobile providing an exemplary application for the present invention.
Figure 2:
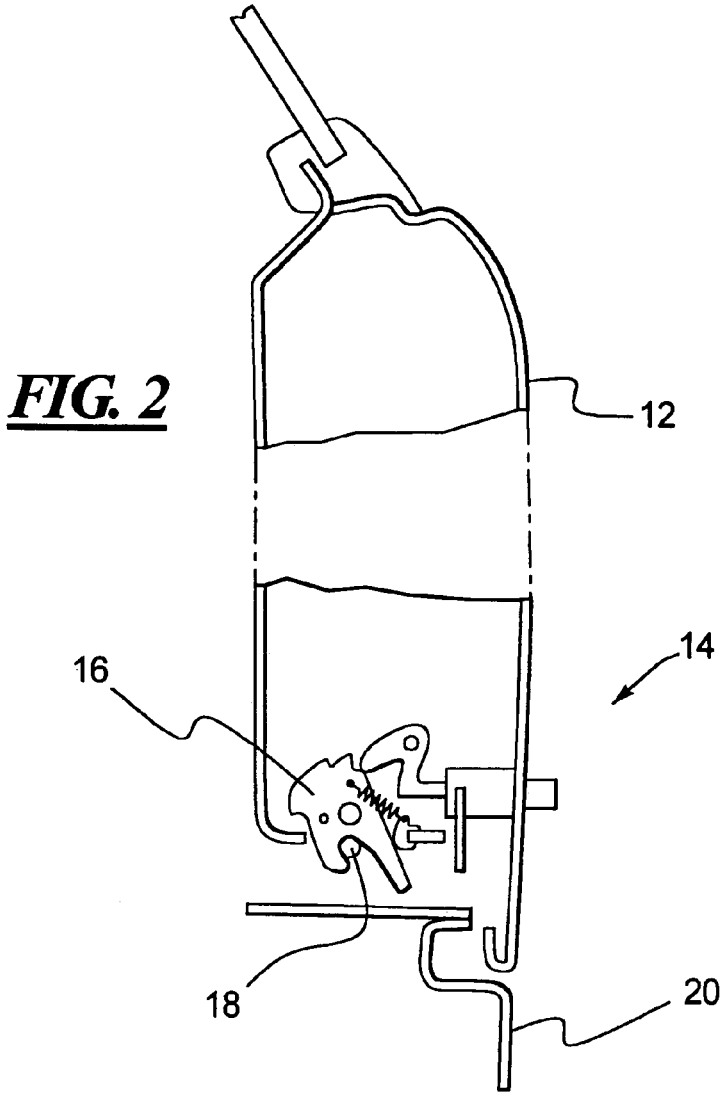
FIG. 2 illustrates a partial door assembly for the automobile of FIG. 1.

As illustrated in FIG. 1, an automobile 10 has a door 12 which can be latched in half-latch and full-latch positions by a door latch 14. As shown in FIG. 2, the door latch 14 includes a door claw 16 mounted to the door 12 and a striker 18 mounted to a post 20 of the frame of the automobile 10.

Figure 3:
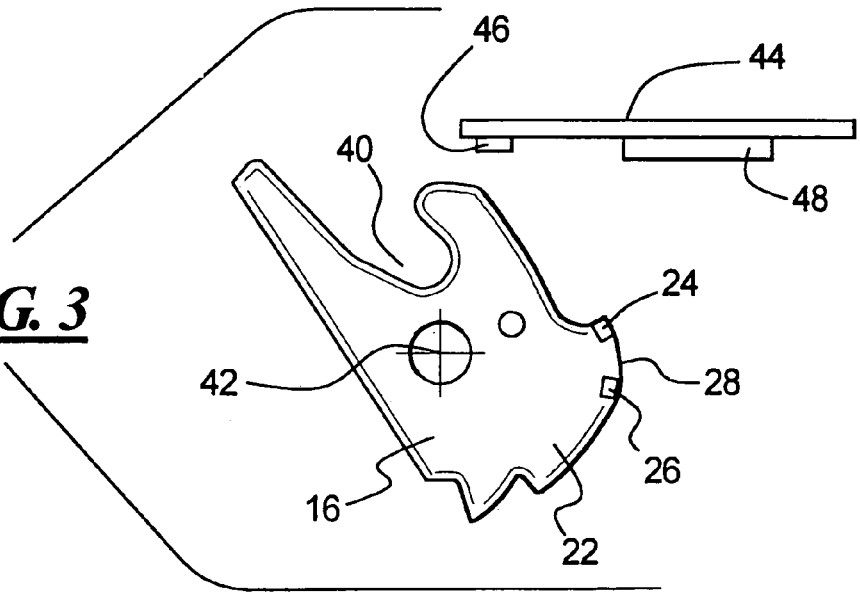
FIG. 3 illustrates the position of a door claw that is part of a door latch for the door of FIG. 2 and that is shown in a door open position.
Figure 4:
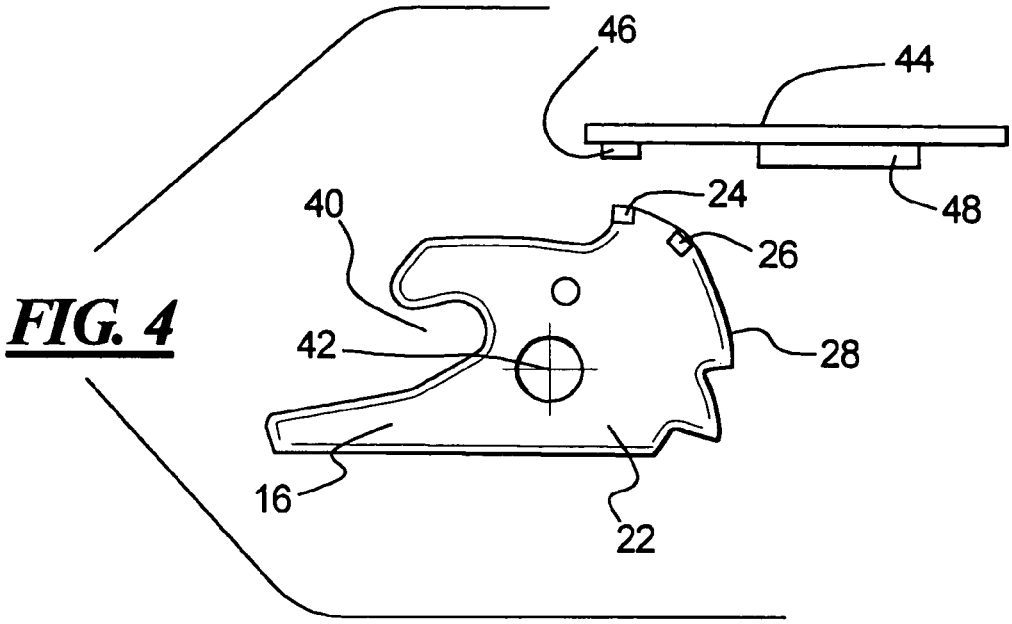
FIG. 4 illustrates the position of the door claw of FIG. 3 when the door claw is in a door half-latch position.
Figure 5:
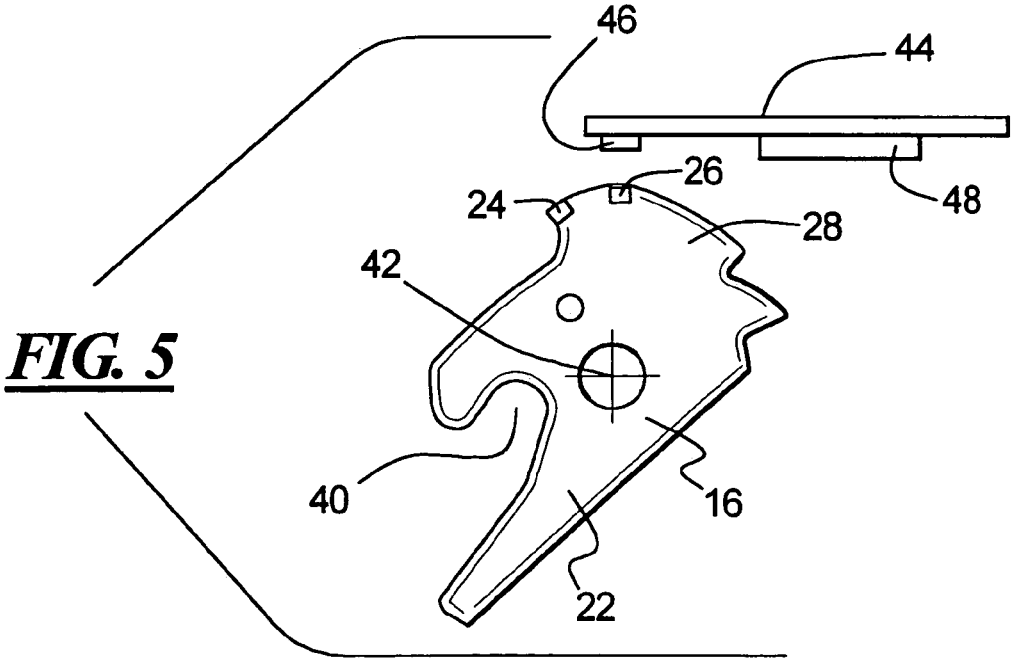
FIG. 5 illustrates the position of the door claw of FIG. 3 when the door claw is in a door full-latch position.

The door claw 16 is shown in more detail in FIGS. 3, 4, and 5. The door claw 16 comprises a door claw plate 22 that is supported by the door 12 of the automobile 10 and in turn supports first and second magnets 24 and 26. The door claw plate 22 has a periphery 28, and the door claw plate 22 supports the first and second magnets 24 and 26 at the periphery 28. The door claw plate 22 also has a recess 40 that engages the striker 18 mounted on the post 20 of the frame of the automobile 10. Thus, as the door 12 is closed, the striker 18 enters the recess 40, engages the door claw plate 22, and rotates the door claw plate 22 about an axis of rotation 42.

Also mounted on the frame of the automobile 10 is a printed circuit board 44 supporting a Hall sensor 46 and a processing circuit 48 comprising one or more electronic and/or electrical components. The printed circuit board 44 electrically couples the Hall sensor 46 to the processing circuit 48. The printed circuit board 44 is mounted on the automobile frame so that the Hall sensor 46 senses the magnetic fields of the first and second magnets 24 and 26 as the first and second magnets 24 and 26 move past the Hall sensor 46 during rotation of the door claw plate 22.

FIG. 3 shows the position of the door claw 16 when the door 12 is fully open, i.e., not in either the half-latch position or the full-latch position. As the door 12 of the automobile 10 closes, the striker 18 mounted to the post 20 of the frame of the automobile 10 enters the recess 40 and begins rotating the door claw 16 about the axis of rotation 42. When the door claw 16 rotates to its half-latch position, the door claw 16 is in the position shown in FIG. 4 where the first magnet 24 is in close proximity to the Hall sensor 46. As the door 12 of the automobile 10 continues to close, the striker 18 mounted to the post 20 of the frame of the automobile 10 continues to rotate the door claw 16 about the axis of rotation 42. When the door claw 16 rotates to its full-latch position such that the door 12 of the automobile 10 is fully closed, the door claw 16 is in the position shown in FIG. 5 where the second magnet 26 is in close proximity to the Hall sensor 46.

The Hall sensor 46 senses the presence of the first and second magnets 24 and 26 and provides corresponding output signals to the processing circuit 48. Based on these outputs signals from the Hall sensor 46, the processing circuit 48 provides half-latch and full-latch outputs to indicate the half-latch and full-latch positions of the door claw 16.

Figure 6:
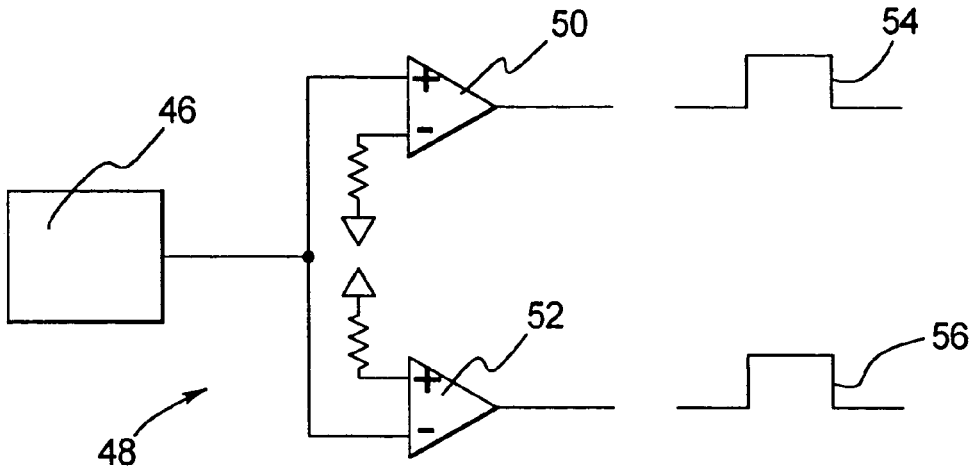
FIG. 6 illustrates an exemplary processing circuit that processes signals emitted by transmitters mounted on the door claw of FIG. 3; and, FIG. 7 shows a relative arrangement of transmitters and signals produced by the door claw and processing circuit shown in FIGS. 3–6.
Figure 7:
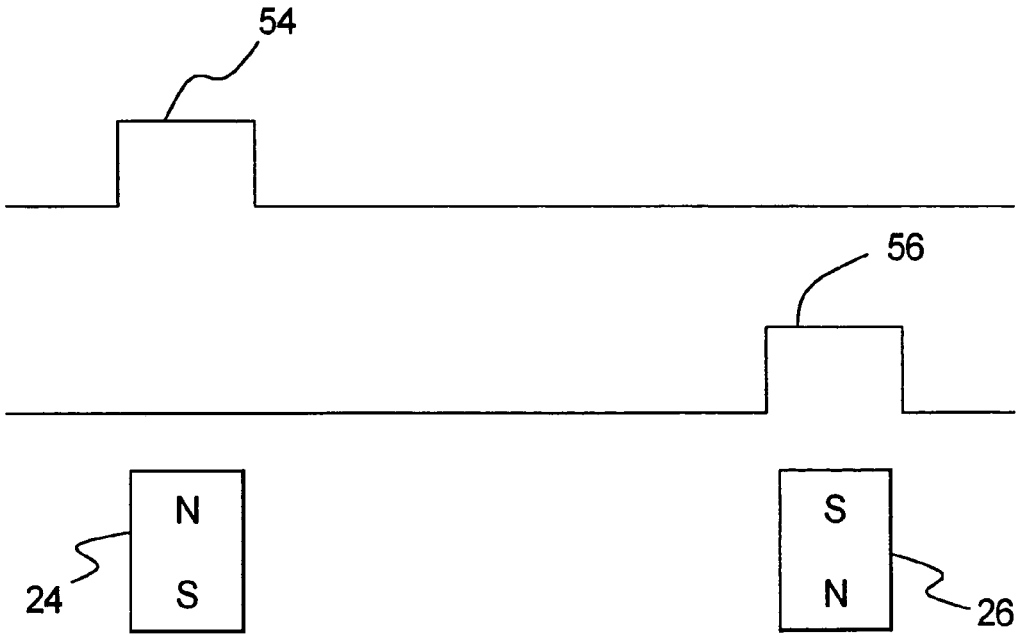

FIG. 6 illustrates an exemplary arrangement for the processing circuit 48, and FIG. 7 illustrates the relative orientation and position of the first and second magnets 24 and 26 to produce half-latch and full-latch outputs from the processing circuit 48. As shown in FIG. 7, the first magnet 24 may be mounted on the door claw 16 with the North pole of the first magnet 24 at the periphery 28. On the other hand, the second magnet 26 may be mounted on the door claw 16 with the South pole of the second magnet 26 at the periphery 28.

With this orientation of the first and second magnets 24 and 26, the Hall sensor 46 provides a positive going signal in response to the first magnet 24 and a negative going signal in response to the second magnet 26. As shown in FIG. 6, the processing circuit 48 includes a non-inverting first operational amplifier 50 having its positive input coupled to the output of the Hall sensor 46, and an inverting second operational amplifier 52 having its negative input coupled to the output of the Hall sensor 46.

Accordingly, as the door claw 16 rotates from its door open position shown in FIG. 3 to its half-latch position shown in FIG. 4, the first operational amplifier 50 produces an output pulse 54 indicating that the door 12 has moved into the half-latch position. Then, as the door claw 16 rotates from its half-latch position shown in FIG. 4 to its full-latch position shown in FIG. 5, the second operational amplifier 52 subsequently produces an output pulse 56 indicating that the door 12 has moved into the full-latch position.

As can be seen, both of the output pulses 54 and 56 are shown with a positive polarity. However, both of the output pulses 54 and 56 may have the same negative polarity, or one of the output pulses 54 and 56 may have a positive polarity and the other of the output pulses 54 and 56 may have a negative polarity.

Moreover, the output pulses may be either voltage pulses or current pulses. Furthermore, instead of providing output pulses on separate pins (the outputs of the first and second operational amplifiers 50 and 52), pulses may be provided on a single pin, in which case, the pulses may be distinguished by different voltage or current levels. Accordingly, the outputs can be two voltage outputs with either different or same polarities, two current outputs with either different or same polarities, one voltage output with several voltage levels, and/or one current output with several current levels. Additionally, an interface can be provided where the information is transmitted serially (for example, using pulse width modulated signals associated with particular sensed conditions).

Certain modifications of the present invention have been discussed above. Other modifications of the present invention will occur to those practicing in the art of the present invention. For example, as described above, the first and second magnets 24 and 26 mounted on the door claw 16 have corresponding magnetic fields, and the Hall sensor 46 is mounted so as to sense the magnetic fields of the first and second magnets 24 and 26. The first and second magnets 24 and 26 may be viewed as magnetic field transmitters, and the Hall sensor 46 may be viewed as a magnetic field receiver. Other types of transmitters may be mounted on the door claw 16 to transmit signals indicating the position of the door claw 16. For example, the transmitters mounted on the door claw 16 may be electromagnetic transmitters, optical transmitters, sonic-transmitters, RF transmitters, etc. The sensor such as the Hall sensor 46 must be suitably chosen to complement the particular transmitter.

Also, as described above, the Hall sensor 46 is stationary with respect to the first and second magnets 24 and 26. However, in some applications, the first and second magnets 24 and 26 may be stationary with respect to the Hall sensor 46.

Accordingly, the description of the present invention is to be construed as illustrative only and is for the purpose of teaching those skilled in the art the best mode of carrying out the invention. The details may be varied substantially without departing from the spirit of the invention, and the exclusive use of all modifications which are within the scope of the appended claims is reserved.

We claim:

1. A system comprising:

a claw of a door latch, wherein the claw has a periphery;

a first magnet having a first North pole and a first South pole, wherein the first magnet is mounted on the claw at the periphery such that the first North pole faces the periphery and the first South pole faces away from the periphery;

a second magnet having a second North pole and a second South pole, wherein the second magnet is mounted on the claw at the periphery such that the second South pole faces the periphery and the second North pole faces away from the periphery; and, a magnetic field sensor arranged to sense the first and second magnets upon relative movement between the magnetic field sensor and the mounting structure.

2. The system of claim 1 wherein the magnetic field sensor comprises a Hall sensor.

3. The system of claim 1 wherein the magnetic field sensor comprises a Hall sensor.

4. The system of claim 1 wherein the first magnet is mounted on the claw in a door half-latch position, and wherein the second magnet is mounted on the claw in a door full-latch position.

5. The system of claim 4 wherein the magnetic field sensor comprises a Hall sensor.

6. An apparatus comprising:

a claw of a door latch, wherein the claw has a periphery;

a first magnet having a first North pole and a first South pole, wherein the first magnet is mounted on the claw at the periphery such that the first North pole faces the periphery and the first South pole faces away from the periphery; and, a second magnet having a second North pole and a second South pole, wherein the second magnet is mounted on the claw at the periphery such that the second South pole faces the periphery and the second North pole faces away from the periphery.

7. The system of claim 6 wherein the first magnet is mounted on the claw in a door half-latch position, and wherein the second magnet is mounted on the claw in a door full-latch position.

* * * * *